US005544414A

United States Patent [19]

Dekker et al.

[11] Patent Number: 5,544,414

[45] Date of Patent: Aug. 13, 1996

[54] SHAVING APPARATUS HAVING CONTOURED HEADS

[75] Inventors: Jacobus N. Dekker, Drachten; Elwin De Valk, Groningen; Fred Fraij, Hoogeveen, all of Netherlands

[73] Assignee: U.S. Philips Corporation, New York, N.Y.

[21] Appl. No.: 333,679

[22] Filed: Nov. 3, 1994

[30] Foreign Application Priority Data

Nov. 5, 1993 [BE] Belgium ..... 09301225

[51] Int. Cl.[6] ..... B26B 19/14

[52] U.S. Cl. ..... 30/43.6; 30/346.51

[58] Field of Search ..... 30/43.6, 43.5, 30/43.4, 346.51

[56] References Cited

U.S. PATENT DOCUMENTS

| | | | |
|---|---|---|---|
| 3,618,210 | 11/1971 | Zuurveen | 30/43.6 |
| 4,393,586 | 7/1983 | Hamashima et al. | 30/43.6 |
| 4,926,550 | 5/1990 | Geertsman et al. | 30/43.1 |
| 4,998,352 | 3/1991 | Tietjens | 30/43.6 |
| 5,390,416 | 2/1995 | Uchiyama et al. | 30/43.6 |

FOREIGN PATENT DOCUMENTS

| | | | |
|---|---|---|---|
| 1066912 | 10/1959 | Germany | 30/43.6 |
| 1916194 | 2/1970 | Germany | 30/43.6 |
| 598664 | 2/1948 | United Kingdom . | |

*Primary Examiner*—Douglas D. Watts
*Attorney, Agent, or Firm*—Ernestine C. Bartlett

[57] ABSTRACT

A shaving apparatus is provided having at least one shaving unit comprising an external shaving member (3) and an internal shaving member (4) which is rotatably drivable relative to the external shaving member, the external shaving member having an annular wall portion (5) with lamellae (7) which extend in substantially radial directions and between which hair-entry apertures are formed, the radial ends (13) of the lamellae having a rounding radius (R) of 0.3–0.7 mm viewed in a radial direction, and the internal shaving member (4) comprising cutters (9) having cutting edges (10) which describe a path (11) adjoining the inner side (12) of the annular wall portion (5) of the external shaving member. In order to improve the shaving performance the shaving apparatus is characterized in that, viewed in radial cross-section, at least a part (14) of the outer side of the annular wall portion (5), which part is situated opposite the annular path (11) of the cutting edges (10), has an outwardly directed arcuate shape, the perpendicular distance (15) between the axially outermost point (16) of this arcuate part (14) and a line through those points (18, 19) of the outer side of the annular wall portion, which are situated directly opposite the inner diameter (20) and the outer diameter (21), respectively, of the annular path (11), being 12–100 μm

3 Claims, 3 Drawing Sheets

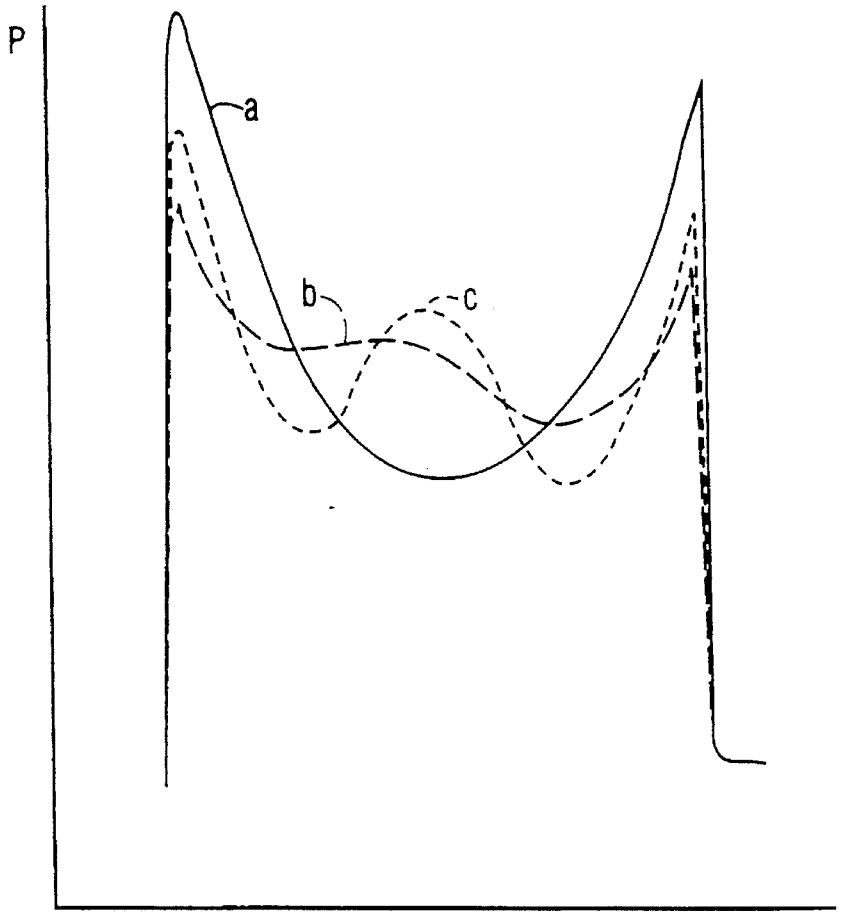
FIG. 4
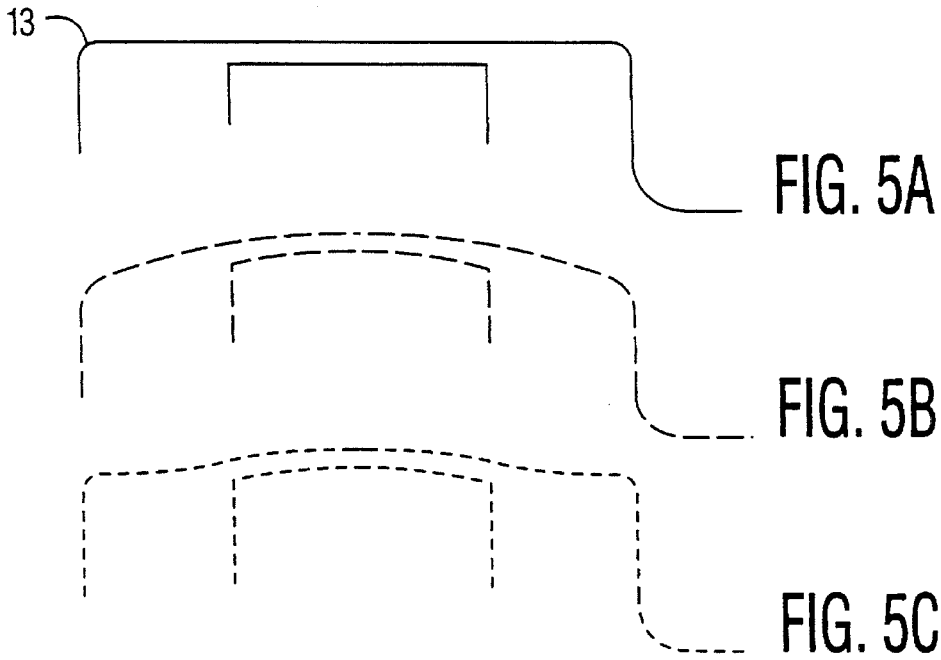

SHAVING APPARATUS HAVING CONTOURED HEADS

FIELD OF THE INVENTION

The invention relates to a shaving apparatus of a type having at least one shaving unit comprising an external shaving member and an internal shaving member which is rotatably drivable relative to the external shaving member, the external shaving member having an annular wall portion with lamellae which extend in substantially radial directions and between which hair-entry apertures are formed, the radial ends of the lamellae having a rounding radius of 0.3–0.7 mm viewed in a radial direction, and the internal shaving member comprising cutters having cutting edges which engage against the inner side of the annular wall portion of the external shaving member.

BACKGROUND

Such a shaving apparatus is known from U.S. Pat. No. 4,926,550. The lamellae of the external shaving member of the known apparatus are flat. In order to ensure that the hairs are effectively caught in the hair-entry apertures it is very important that the ends of the lamellae have a rounding of a suitable radius. In practice, it has been found that in shavers in accordance with U.S. Pat. No. 4,926,550 the rounding radius should not exceed 0.7 mm. Another important factor is the shaving sensation, i.e. the extent to which the shaver feels rough to the skin. The shaving sensation is influenced by the magnitude of said rounding radius. In practice, a rounding radius of 0.3–0.7 mm is found to be favorable with a view to the shaving sensation. A smaller radius gives an increased sensation of roughness.

SUMMARY OF THE INVENTION

It is an object of the invention to improve the shaving performance, i.e. to sever the hairs closer to the skin, whilst the shaving sensation is preserved or even improved.

For this purpose, in accordance with the invention, the shaving apparatus of the type defined in the opening paragraph is characterized in that, viewed in a radial cross-section, at least a part-of the outer side of the annular wall portion, which part is situated opposite the annular path of the cutting edges, has an outwardly directed arcuate shape, the perpendicular distance between the axially outermost point of this arcuate part and a line through those points of the outer side of the annular wall portion, which are situated directly opposite the inner diameter and the outer diameter, respectively, of the annular path, being 12–100 μm.

It has been found that the shaving performance is influenced by the contact pressure between the external shaving member and the skin. When an external shaving member having flat lamellae and a rounding radius of 0.5 mm at the radial ends of the lamellae U.S. Pat. No. 4,926,550 is pressed onto the skin a high contact pressure will occur at the radial edges of the lamellae and a low contact pressure will occur in the centres of the lamellae where cutting is effected.

In the shaving apparatus in accordance with the invention the contact pressure at the outwardly convex part of the lamella appears to be higher but at the radial ends of the lamellae it appears to be lower than in the shaver in accordance with said U.S. Patent. As a result, the shaving apparatus will feel more comfortable as it is moved over the skin. As a result of the increased contact pressure in the center of the lamella a hair is severed closer to the skin because the skin penetrates slightly deeper into the hair-entry aperture.

Shaving apparatus having a curved external shaving member are known per se, for example from GB-A-598,664. The external shaving member known from this document is semicircular, which yields a stiff construction. This enables the thickness of this shaving member to be made substantially smaller than in the shaving apparatus known until then, without the risk of deformation. As a result, the hairs are severed closer to the skin. However, a disadvantage of such strongly curved lamellae is that the hairs are caught less effectively. When such a shaver is moved over the skin the hairs are virtually flattened and, as a result, cannot be erected properly between the lamellae. Moreover, the ends of the lamellae generally will not contact the skin, which reduces the shaving performance.

U.S. Pat. No. 3,618,210 discloses a rotary shaving apparatus using a curved flexible foil for the external shaving member. Here, the ends of the lamellae are situated underneath a rim of the shaver housing, which results in a poor entry of hairs. However, there is no rounding at the ends of the lamellae.

It is the very combination of an outwardly directed slightly curved surface with a small rounding radius near the edges which yields a better shaving performance (the hairs are severed closer) and a considerably better shaving sensation.

Preferably, the outer edges of the outwardly directed arcuate part smoothly adjoin the rounded radial ends of the annular wall portion. Between the outwardly directed arcuate part and the rounded radial ends of the annular wall portion an inwardly directed arcuate part may be provided, which is disposed at least opposite the edges of the annular path of the cutting edges. This results in an even further reduction of the likelihood of skin injury, because the contact pressure and, consequently, the curvature of the skin are minimal.

BRIEF DESCRIPTION OF THE DRAWINGS

The invention will now be described in more detail on the basis of an exemplary embodiment shown in the drawings. In the drawings:

FIG. 5 shows diagrammatically the different external shaving members corresponding to the contact-pressure curves in FIG. 4.

DETAILED DESCRIPTION OF THE PREFERRED EMBODIMENTS

The shaving apparatus comprises a housing 1 with three shaving units 2. A shaving unit 2 comprises an external shaving member it and an internal shaving member 4, which is rotatably drivable relative to the external shaving member. In known manner the internal shaving member can be driven by means of an electric motor, not shown, which is accommodated in the housing.

Figure 1:
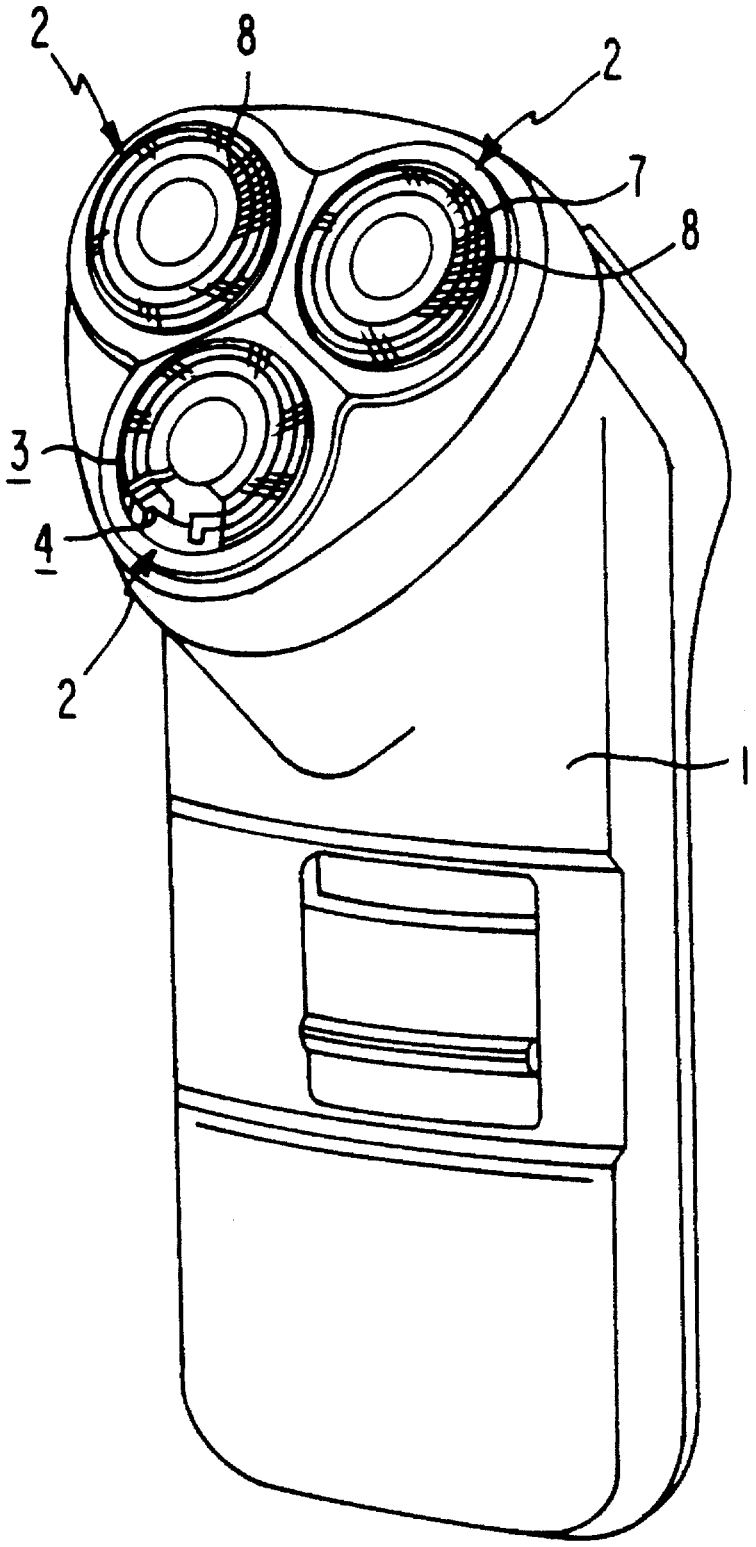
FIG. 1 is a perspective view of a shaving apparatus comprising three shaving units.
Figure 2:
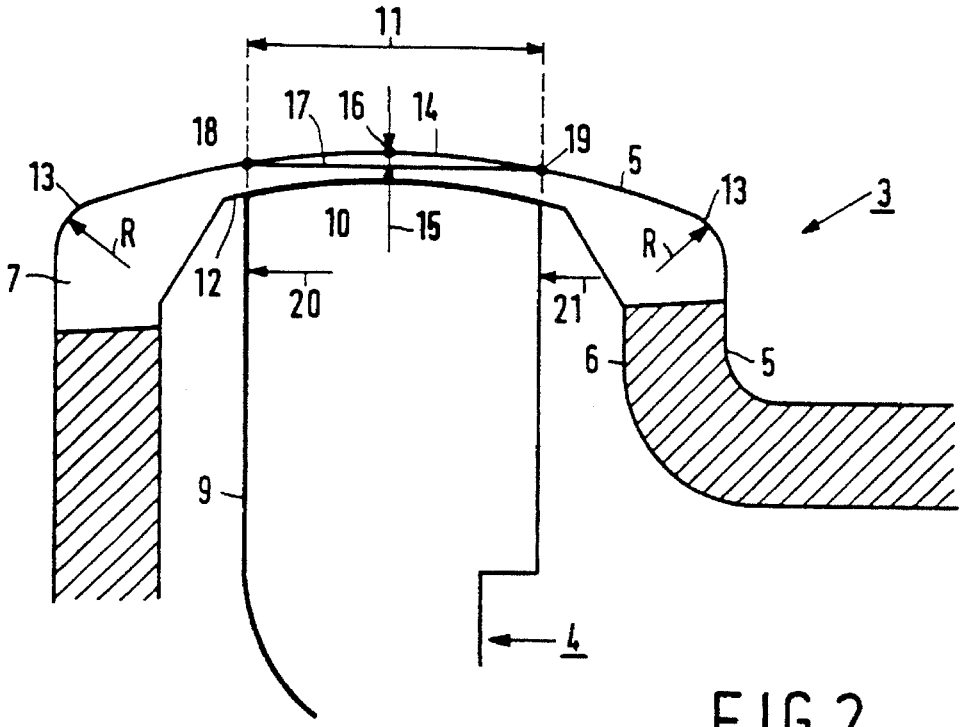
FIG. 2 shows an external shaving member with curved lamellae in a cross-sectional view and to a highly enlarged scale.

The external shaving member 3 has a substantially annular wall portion 5. As is shown in FIG. 2, the inner side of the external shaving member has an annular groove 6 at the location of the wall portion 5. The wall portion 5 is constituted by lamellae 7 which extend in substantially radial directions and between which hair-entry apertures 8 are formed. The internal shaving member i comprises cutters 9 having cutting edges 10 which describe a path 11 adjoining the inner side 12 of the groove 6 in the external shaving member it, which groove is formed by the lamellae 7. The radial ends 13 of the lamellae are rounded with a radius $R_1$, of approximately 0.5 min. Viewed in a radial cross-section (FIGS. 2, 3) a part 14 of the external surface of the annular wall potion 5 of the external shaving member, which part is situated opposite the annular path 11 of the cutting edges 10, has an outwardly directed arcuate shape. The degree of outward curvature is determined by the perpendicular distance 15 between the axially outermost point 16 of this arcuate potion and a line 17 through those points 18, 19 of the outer side of the annular wall portion which are situated opposite the inner diameter 20 and the outer diameter 21, respectively, of the annular path. This distance is 12–100 μm. The outer surface of the annular wall portion 5 is consequently a toroidal surface.

Figure 3:
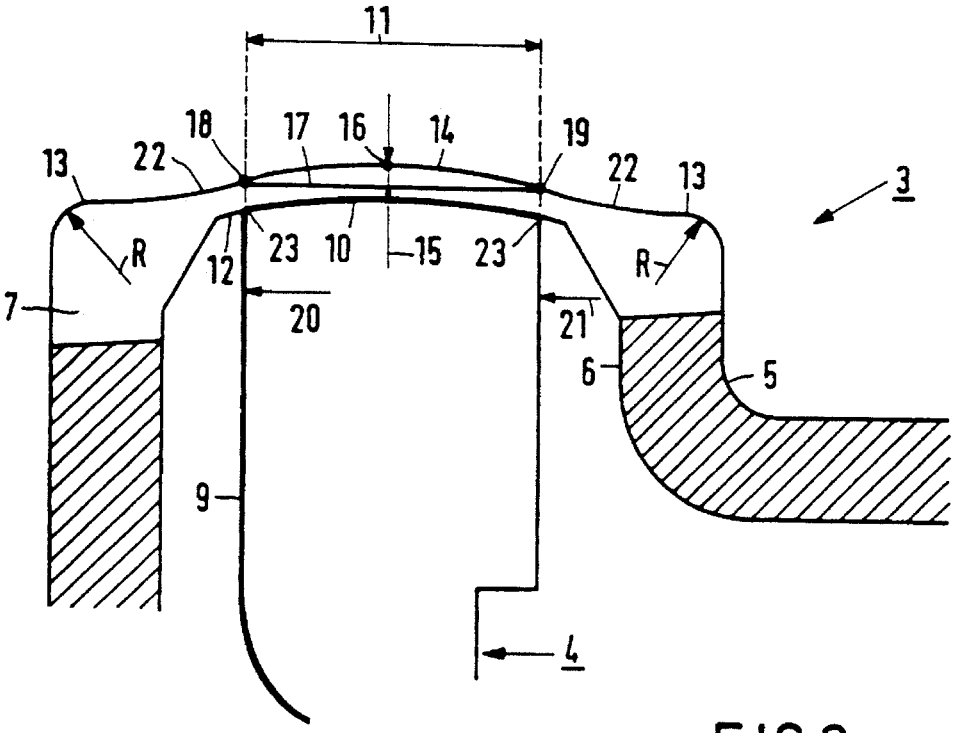
FIG. 3 shows another external shaving member with curved lamellae in a cross-sectional view and to a highly enlarged scale, FIG. 4 show the variation in contact pressure between the skin and the lamellate annular portion of different external shaving members.

FIG. 3 shows a slightly different shape of the outer surface of the external shaving member. In this case an inwardly directed arcuate part 22 is provided between the outwardly directed arcuate part 14 and the rounded radial ends 13. This inwardly directed part is disposed at least opposite the edges 23 of the cutting edges 10.

The arcuate parts join one another and the rounded radial ends of the annular wall portion smoothly.

FIG. 4 shows curves representing the contact pressure between the skin and the external shaving member for different outer surfaces. FIG. 5 shows diagrammatically the profile of the various outer surfaces of the annular wall portion of an external shaving member corresponding to said contact-pressure curves. The solid line (a) represents the situation for a shaving member comprising flat lamellae U.S. Pat. No. 4,926,550, the dashed line (b) represents the situation for a shaving member comprising only outwardly curved lamellae (as shown in FIG. 2), and the dotted line (c) represents the situation in which the lamella has an outwardly curved central part with an inwardly curved part at either side (as shown in FIG. 3). As is clearly visible, the contact pressure at the edges 13 of lamellae having a flat surface is substantially higher than at the edges of lamellae having a curved surface, whereas in the center of the lamella the situation is exactly the opposite, i.e. a contact pressure which is higher for a curved than for a flat lamella. In the situation represented by the dotted line it is clearly visible that the contact pressure is low near the edges 23 of the cutting edges. The higher contact pressure in the central portion of the lamella results in a hair being severed closer to the skin. The lower contact pressure at the edges results in an improved shaving sensation, i.e. the shaving apparatus feels more pleasant to the skin. Moreover, owing to the curved shape of the lamella the shaving apparatus can be moved more easily over the skin.

We claim:

1. A shaving apparatus having at least one shaving unit comprising an external shaving member and an internal shaving member which is rotatably drivable relative to the external shaving member, the external shaving member having an outwardly directed annular wall portion with lamellae which extend in substantially radial directions and between which hair-entry apertures are formed, the edges of the annular wall portion having a rounding radius of 0.3–0.7 mm viewed in a radial direction, and the internal shaving member comprising cutters having cutting edges which describe an annular path adjoining the inner side of the annular wall portion of the external shaving member, characterized in that, viewed in a radial cross-section, at least a part of the outer side of the annular wall portion, which part is situated opposite the annular path of the cutting edges, has an outwardly directed arcuate shape, the perpendicular distance between the axially outermost point of this arcuate part and a line through those points of the outer side of the annular wall portion, which are situated directly opposite the inner diameter and the outer diameter, respectively, of the annular path, being 12–100 μm.

2. A shaving apparatus as claimed in claim 1, characterized in that the outer edges of the outwardly directed arcuate part smoothly adjoin the rounded radial ends of the annular wall portion.

3. A shaving apparatus as claimed in claim 1, characterized in that the outer edges of the outwardly directed arcuate part are adjoined by an inwardly directed arcuate part which is disposed at least opposite the edges of the annular path of the cutting edges.

* * * * *